US007514657B2

(12) United States Patent
Moreira et al.

(10) Patent No.: US 7,514,657 B2
(45) Date of Patent: Apr. 7, 2009

(54) PROCESS FOR REDUCING THE ACIDITY OF HYDROCARBON MIXTURES

(75) Inventors: Elizabeth Marques Moreira, Rio de Janeiro (BR); Mauri Jose Baldini Cardoso, Rio de Janeiro (BR)

(73) Assignee: Petroleo Brasiliero S.A - Petrobras (BR)

( * ) Notice: Subject to any disclaimer, the term of this patent is extended or adjusted under 35 U.S.C. 154(b) by 184 days.

(21) Appl. No.: 11/516,646

(22) Filed: Sep. 7, 2006

(65) Prior Publication Data

US 2007/0056880 A1 Mar. 15, 2007

(30) Foreign Application Priority Data

Sep. 15, 2005 (BR) ..... 0503793

(51) Int. Cl.
*H05B 6/64* (2006.01)
*C10G 17/00* (2006.01)

(52) U.S. Cl. ..... 219/679; 208/263

(58) Field of Classification Search ..... 219/679, 219/678, 687, 680, 681, 682, 684; 208/263, 208/264, 265, 266, 267; 585/263
See application file for complete search history.

(56) References Cited

U.S. PATENT DOCUMENTS 4,199,440 A 4/1980 Verachtert
4,300,995 A 11/1981 Liotta
4,376,107 A * 3/1983 Morgenthaler ..... 423/531
4,582,629 A 4/1986 Wolf
4,647,366 A 3/1987 Edmondson
4,853,119 A 8/1989 Wolf
5,182,013 A 1/1993 Petersen
5,389,240 A 2/1995 Gillespie
5,871,636 A 2/1999 Trachte
5,985,137 A 11/1999 Ohsol
6,027,636 A 2/2000 Poirier
6,054,042 A 4/2000 Gorbaty
6,086,751 A 7/2000 Bienstock
6,184,427 B1 2/2001 Klepfer
6,190,541 B1 2/2001 Siskin
6,207,342 B1 * 3/2001 Takechi et al. ..... 430/270.1
6,258,258 B1 7/2001 Sartori
6,454,936 B1 9/2002 Veradaraj
7,060,286 B2 * 6/2006 Chung et al. ..... 424/401
2007/0056880 A1 * 3/2007 Moreira et al. ..... 208/189

FOREIGN PATENT DOCUMENTS

WO WO 01/79386 10/2001
WO WO 2004/005434 1/2004

* cited by examiner

*Primary Examiner*—Daniel L Robinson
(74) *Attorney, Agent, or Firm*—Nixon & Vanderhye PC

(57) ABSTRACT

A process to reduce acidity of hydrocarbon mixtures (1) is described, that includes sending a hydrocarbon stream to a Microwave Treatment Unit (MTU), with a fixed stream or mud bed of microwave absorbent materials, pure or in mixtures, such as coke fines, spent catalysts that have already been used in FCC units or hydrotreatment (HDT) in a refinery, or even new catalysts which may be sulfided or not, under processing conditions.

25 Claims, 4 Drawing Sheets

PROCESS FOR REDUCING THE ACIDITY OF HYDROCARBON MIXTURES

CROSS REFERENCE TO RELATED APPLICATION

This application is based upon, claims the benefit of, priority of, and incorporates by reference, the contents of Brazilian Patent Application No. PI 0503793-0 filed Sep. 15, 2005.

FIELD OF THE INVENTION

The field of the present invention is found among processes to reduce the acidity of hydrocarbon mixtures. In particular, within the processes that involve treatment of hydrocarbon mixtures in the presence of microwave absorbent materials, preferably those that absorb radiation in localized sites, capable of reducing the acid concentration in said mixtures under the irradiation action of electromagnetic waves.

DESCRIPTION OF THE STATE OF THE ART

The predominance of heavy fractions with a high percentage of contaminants and elevated acidity in new oil reservoirs has been a challenge for oil processing companies. In the case of Brazil, the development of national petroleum reserves has indicated that Petrobras will have to process oils with ever increasing levels of acidity. Some of the oils, which have not yet begun to be exploited on a commercial scale, possess extremely high levels of naphthenic acidity (between 3 and 10 mg of KOH/g of oil), and are incompatible with the current material project specifications of the Petrobras' refinery. Metallurgic adequacy of industrial units is obtained by substituting equipment, metal pipes, etc., and is a function of naphthenic acid distribution in the oil fractions, which are subject to changes in processing oils coming from new reservoirs.

The high acid content not only affects the processing of petroleum products and their fractions but also influences the marketing of crude oil. Currently, the market devalues the price of raw materials in an amount ranging between US $0.50 and US $0.70 per barrel per unit with a total acid number (TAN) of over 0.5 mg KOH/g of oil.

Moreover, the polarized character of carboxyls present favors the formation of emulsions, especially in heavier oils, reducing the efficiency of the desalination stage of petroleum, making the separation of the water/oil emulsions formed more and more problematic. Therefore, reducing acidity is a critical stage not only in terms of costs, but also in the refining process.

Some patents protect processes for reducing the acidity of petroleum and derivatives.

One of the first approaches would be to use oil mixtures with different levels of acidity.

The application of corrosion inhibitors is another solution used to work around the problem of acidity. In this vein, the U.S. Pat. No. 5,182,013 discloses that organic polysulfides are inhibitors effective against corrosion caused by naphthenic acids in refinery distilling units.

U.S. Pat. No. 4,647,366 recommends adding an oil soluble products derived from an alkanediol and a polyamine alkylene as inhibitors to naphthenic corrosion.

Acidity may be reduced even by treating oil with alkaline solutions of sodium hydroxide or potassium hydroxide, as discussed in U.S. Pat. No. 4,199,440. However, this approach demands the preparation of basic solutions that are sufficiently concentrated, and that at a critical point, the formation of emulsions are difficult to separate. Therefore, this solution would be applicable only for low basic concentrations.

Treatment with a calcium sulfonate or naphthenate based alkaline detergent with at least 3% of calcium content is recommended in U.S. Pat. No. 6,054,042 to work around the problem of emulsions. The oil is treated at temperatures between 100° C. and 170° C. with stoichiometric proportions of calcium for acid functionality in the oil of close to 0.025:1 up to 10:1 moles, or 0.25:10:1, or other proportions.

U.S. Pat. No. 6,258,258 recommends the use of polymeric amine solutions, such as polyvinyl pyridine.

U.S. Pat. No. 4,300,995 recommends treatment of carbon and liquids obtained from carbon, coming from vacuum gas oil and petroleum sediment that introduce acidic functionalities, with alkaline solutions of quaternary ammonium hydroxides in alcohol or water, such as hydroxide of tetramethylammonium.

International patent WO01/79386 uses an alkaline solution with group IA, IIA metal and ammonium hydroxides and the application of a transfer agent such as, for example, non-alkaline quaternary salts and polyethers.

The use of bases and/or phosphates with an alcohol is recommended in U.S. Pat. No. 6,190,541.

In U.S. Pat. No. 6,086,751, naphthenic acidity is reduced through the application of a thermal treatment. The oil is initially submitted to a heating process in a reactor with a short dwell time to remove water and then is submitted to temperatures of between 340° C. and 420° C., with a pressure lower than 100 psig and reaction times of up to 2 hours.

In U.S. Pat. No. 5,985,137, the naphthenic acidity and the sulfur content of the oil are reduced through the reaction with alkaline-earth metal oxides, forming neutralized and alkaline-earth metal sulfate compounds. The temperature must be higher than 150° C. to remove the carboxylic acids and higher than 200° C. for the sulfide salts to form. The pressure applied must keep the material from vaporizing.

In general, the majority of the methodologies for reducing naphthenic acidity involving thermal treatments with or without the addition of alkaline solutions demand the application of surfactants to work around the problem of emulsions.

Another approach is the adsorption of the naphthenic acid through adsorbent compounds with catalytic properties, under temperatures between 200° C. and 500° C., followed by the recovery of the related adsorbent agent.

U.S. Pat. No. 5,389,240 describes a process for removing naphthenic acids from petroleum streams like kerosene in the presence of a material related to hydrotalcite called MOSS ("metal oxide solid solution") in combination with an annealing process. In order for the material to be adequate for the objectives of the patent, it must be calcinated at about 400° C. The described technology is applicable to streams containing extremely reduced naphthenic acid content, with TAN in the range of 0.01 to 0.06 mg KOH/g oil, and may reach up to 0.8 mg KOH/g oil.

U.S. Pat. No. 6,027,636 protects the process of elementary sulfur removal and sulfurous contaminants present in refined petroleum products through contact of the fluid containing mercaptans through an adsorbent selected from one of the following: Baierite, Brucite and derivatives of Hydrotalcite.

The use of a hydrotreatment catalyst for the reduction of naphthenic acidity is mentioned in U.S. Pat. No. 5,871,838.

Said patent refers to the use of a VIB and VIIIB transition metal sulfide catalyst, supported in oxidized alum. For example, a cobalt and molybdenum catalyst (KF-756 created by Akzo-Nobel), supported in a matrix of porous oxidized alum with a surface area within a range of between 100 to 300 $m^2/g$ which has been sulfonated prior to use. By using the proposed technology of this US patent in an absence of hydrogen, a maximum reduction of naphthenic acidity of 53% in crude oil having an initial TAN of 4 mg KOH/g is achieved.

Brazilian patent application PI 0202552-3, from the present assignee, explains a method of reducing naphthenic acid in oil and its derivative by using an adsorbent substance in the specific area of between 100 and 200 $m^2/g$, made up of a catalyst overlaid with carbon compounds having a high molecular weight.

U.S. Pat. No. 6,184,427 presents the application of microwaves for cracking by temperature and electrical discharge of plastic materials and hydrocarbons in general with the use of microwave absorbent materials (sensitized) added to the process stream. The sensitizers mentioned in the patent are for converting the electric radiation into thermal energy and electrical discharges within a reactive environment with low radiation absorption. However, nothing is said about removing or reducing naphthenic acidity or about heating active catalyst sites.

U.S. Pat. Nos. 4,582,629 and 4,853,119 propose the use of microwaves to break down emulsions, however nothing is recommended for the removal or reduction of naphthenic acidity.

U.S. Pat. No. 6,454,936 mentions the use of microwaves to separate the emulsion formed from oil and water, but the objective of the technology discussed therein is not to use microwaves to reduce the level of naphthenic acid in the oil, but only to separate the emulsion.

Therefore, in spite of advances in processes to reduce acidity of hydrocarbon mixtures, it is still necessary to continue developing a process involving the placement of a microwave unit in contact, under processing conditions, whether it be in the presence of hydrogen or not, with the hydrocarbon mixture with materials that absorb microwaves. These materials should mainly be able to absorb radiation in localized sites, and capable of reducing the concentration of acid in the above mentioned mixtures under the action of electromagnetic waves irradiation and, if necessary, to exchange heat before or after the microwave treatment, and to recover a hydrocarbon mixture of TAN reduced by up to 70%, and direct the treated mixture towards a process downstream, such as the process being described and claimed in the present application.

SUMMARY OF THE INVENTION

Broadly speaking, the present process to reduce acidity of hydrocarbon mixtures includes:

a) preheating the mixture to be treated, to a temperature of between 120 and 450° C., by any method known;

b) directing the warm mixture to a microwave treatment unit (MTU) where it is placed into contact, continuously or in batches, with electromagnetic irradiation waves, with a fixed stream or mud bed, made from a microwave absorbent material, with or without the use of hydrogen, under pressure such that, after the treatment, the stream will be at the normal pressure of the system downstream (desalination or atmospheric distillation);

c) recovering the treated hydrocarbon stream containing a reduced TAN value; and d) directing the treated hydrocarbon stream to the conventional oil refining flow while the microwave absorbent material, when deactivated, is discarded by the conventional method usually used in heavy hydrocarbon stream treatment units.

The microwave treatment unit (MTU) may be located upstream or downstream from most of the refining processing units, where a reduction in the acidity of hydrocarbon mixtures fractions is desirable, as will be described below.

Thus, the invention provides a process for the reduction of the acidity of hydrocarbon mixtures by putting said mixture in contact, in a microwave treatment unit, the action of the electromagnetic wave irradiation, with a fixed stream or mud bed, a microwave absorbent material, with or without the use of hydrogen.

The invention also provides a process for the reduction of the acidity of hydrocarbon mixtures that is more efficient, of lower cost and where the formation of emulsions is minimized, in order to facilitate the separation of products.

Additionally, the invention provides a process for the reduction of the acidity in hydrocarbon mixtures with the added advantage resulting from the reutilization of spent materials, which are, therefore, of low cost, and thus delays their disposal and treatment as refuses.

The invention also proves a process for reducing the acidity of hydrocarbon mixtures where additional gains are possible, such as viscosity reduction in treated hydrocarbon streams, reduction of the level of contaminants, such as nitrogen and sulfur, cracking of heavy fractions, etc.

DETAILED DESCRIPTION OF THE INVENTION

Figure 1:
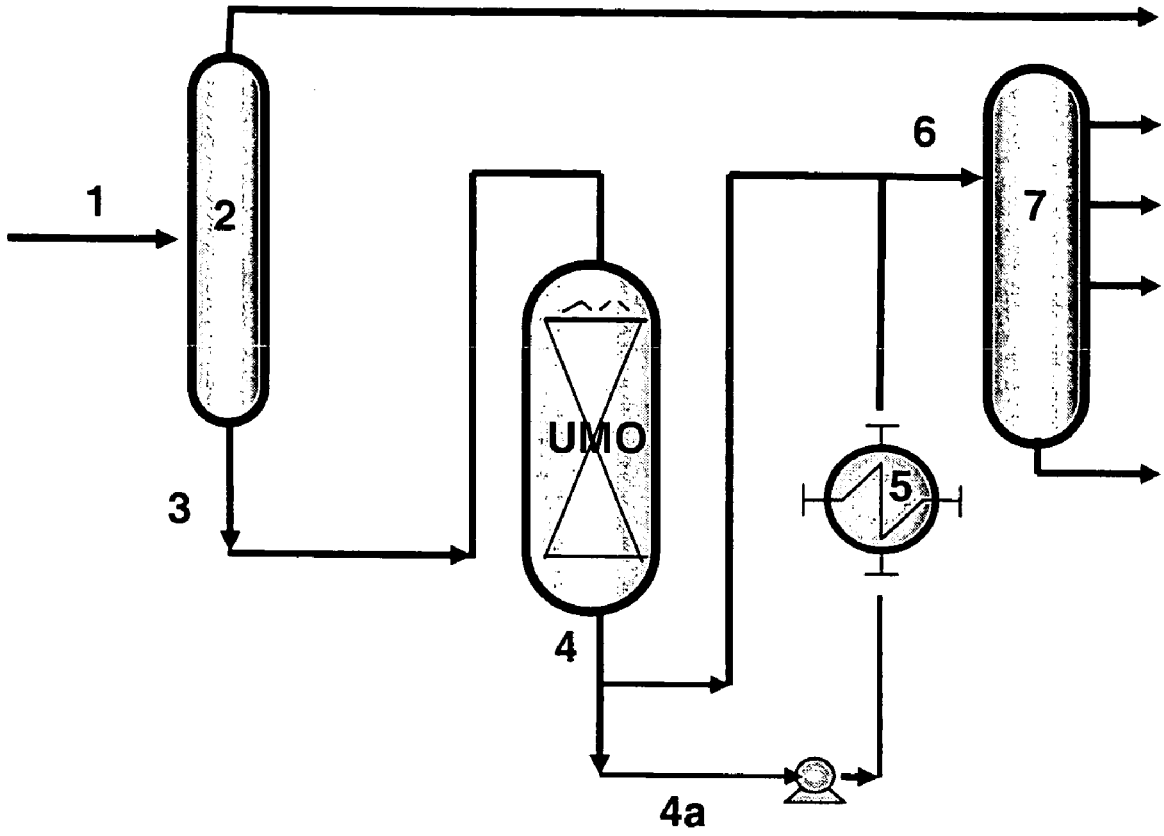
FIG. 1 is a schematic flowchart with a first embodiment of the process of the invention, and it refers to a unit for treating hydrocarbon mixtures after the preflash tower.

Naphthenic acids are predominantly made up of carboxylic cycloaliphatic acids substituted with alkyl, with lower proportions of non-cycloaliphatic acids. Aromatic, olefinic, hydroxylic and dibasic acids may be present as minor components. The molecular weight of the naphthenic acids present in crude, as determined by mass spectrometry, varies between 200-700.

The naphthenic acid species removed by the process of the invention are monobasic carboxylic acids (RCOOH, where R is the naphthenic segment). For the purposes of the invention, the term "naphthenic acid" means naphthenic carboxylic acid, or naphthene-aromatics.

In the present invention, the total acidity levels have been determined by the ASTMD-664 method. At the same time, the infra-red spectrums of some samples show variations in the spike of carbonyl absorption from carboxylic naphthenic acid in the zone of around 1715 $cm^{-1}$. Method ASTMD-664 (determined TAN) and the infra-red method (predicted TAN) are related, quantitatively, through the levels of acidity "versus" the concentration of carboxyl, and the results were compared in mg KOH/ g sample.

The process proposed by the present invention is based on the synergic effect between the action of the microwaves and the active sites of the adsorbent material or catalyst, where overheating occurs locally, inducing the reaction between the organic acids and the surface or the active sites of the absorbent microwave material, at lower temperatures than those used in a conventional thermal process.

In this way, the process proposed offers and alternative application for a spent catalyst, considered today to be refuse of extremely low value, a pollutant and hazardous waste material.

One way to assess the absorption capacity for microwave radiation of a material is to verify its dielectric properties. The dielectric loss factor ("loss factor" or "loss tangent") supplies a good indication of how much material can be penetrated by an electric field and dissipate this energy in the form of heat.

Serviceable streams for the process of the invention include petroleum, its fractions and derivatives, which present TAN measured levels of naphthenic acid between 1 and 10 mg KOH/g oil, preferably as TAN included in a range of values between 1.5 the 8 mg KOH/g oil. Regarding the water level, the streams tested in the examples were petroleum with BSW lower than 1%.

Useful microwave absorbent material for the process include carbon fines, spent FCC catalysts, spent hydrotreatment catalysts, preferably those that absorb radiation on localized sites, such as hydro-refining catalysts, exactly like those that have already been used in refinery units (HDT).

Moreover, the microwave absorbent materials include coke fines refuse, catalysts or a mixture of discarded catalysts from fluid catalytic cracking units, catalysts or a mixture of discarded catalysts from hydro-treatment units, made up of transition metals (Co—Mo, Ni—Mo, etc), supported in refracting oxides that may be chosen from the following: oxidized alum, silica, titanium, zirconium and/or mixtures, among others, where the material that supports the active phase of the absorbent material may be, preferably, transparent to microwaves.

Regarding spent catalysts; they may or may not go through an intermediary rectification stage in the presence of an inert gas;

A preferred spent catalyst is a catalyst from catalytic hydro-cracking unit (HDT). It may be sulfided or not before being used as a microwave absorbent material.

The area specific requirements for useful materials for the present process are the same as those used for conventional catalysis. Therefore, the larger the active area, the greater the dispersion of the active phase and the better the performance of the process will be. The limits are due to the depth of penetration of the microwaves in the active phase. In case the size of the active phase particles in interaction with the microwaves are larger than the penetration of the microwaves in this material, only the external layers of these particles will interact with the microwaves. Therefore, good dispersion of the active phase, supported on a material that is transparent to microwaves, is desirable from the classic point of view of the how much these materials interact with the microwaves.

The mass relation of the material that absorbs microwaves/hydrocarbon mixture is within a range of values of between 0.05 and 1, preferably within a range of values of between 0.1 and 0.5.

Spent catalyst is understood to mean the catalyst or mixture of catalysts already used in HDT units in a refinery. The referred treatment promotes a reduction of TAN in the hydrocarbon stream of up to 70%. Other studies are being developed, that may increase this number.

Microwave treatment units (MTU), useful for the present process, include microwave ovens, either conventional or not, commercial or not, one mode or multi-mode, pulse or continuous, with fixed or variable microwave power and frequency.

The microwave equipment used in the present process, (not limited to this process only), was an microwave oven adapted from the ETHOSPLUS model, manufactured for the Milestone Laboratory Systems, with total power of up to 1000 W, pulse or continuous type, with a frequency of 2.45 MHz.

The process proposed is carried out in the presence of gaseous hydrogen or not. When carried out in the presence of hydrogen the benefits of the present process are added synergetically to the conventional benefits of hydrotreatment or hydrocracking.

The process proposed is fully implemented for the treatment of specific streams such as, crude oil, diesel oil, light recycled oil, (LCO), aviation kerosene, vacuum gas oils, coke gas oils, etc.

The basic design proposed in the present application consists of the insertion of one or more units for the generic treatment of hydrocarbon mixtures to be submitted to the action of microwaves, at least in one of the processing stages described below.

The stages of the process include:

a) Preheating the hydrocarbon mixture with the presence of high acid total values to be treated at temperatures that characteristically fall within a range of between 120° C. and 450° C.;

b) Placing the referenced hydrocarbon mixture in continuous contact with a fixed stream or mud bed, constituted of a microwave absorbent material, such as a spent catalyst proceeding from a hydrotreatment unit, in the presence of gaseous hydrogen or not, submitted to the action of microwave power, within the range of 1 mm to 30 cm or of 1 to 30 GHz at a temperature of between 120° C. and 450° C., preferably at a temperature within a range of between 140° C. and 350° C.;

c) Continual withdrawal of the irradiated hydrocarbon mixture containing a reduced TAN value for later processing in refinery units (for example, conventional petroleum refinery units) of a refining system;

and where:

i) The pressure will be such that, after the treatment, the treated hydrocarbon mixture stream should be at the normal pressure of the refining system; and ii) The spatial velocity of the treated hydrocarbon mixture falls in a range of between 0.25 $h^{-1}$ and 10 $h^{-1}$, preferably within a range of between 0.5 $h^{-1}$ and 4 $h^{-1}$.

d) Disposal of the microwave absorbent material at the end of the campaign time, in the usual way used in (e.g., conventional) units used for heavy streams.

The proposed technology has as an additional advantage: the reutilization of spent material; therefore at a lower cost, and thus delays their disposal and treatment as refuse.

A typical petroleum refining process comprises the following steps:

a) heating the crude oil in a heat exchanger, thus obtaining a heated crude oil;

b) desalting the heated crude oil in a desalter, thus obtaining a desalted crude oil;

c) separating the light fractions from the desalted crude oil in a preflash tower, thus obtaining a treated oil; and d) distilling the treated oil from the preceding step in a atmospheric distillation tower and in a vaccum distillation tower.

The present process to reduce naphthenic acidity from petroleum products and their fractions that contain high levels of TAN may be implemented at various points in the refinery, such as for example: before the desalination area in production and/or refining units, after the desalination area and before the preflash tower, after the preflash tower, before the fluid catalytic cracking unit, or inserted upstream or downstream of the derivative products finishing processes where extra reduction of acidity is desirable.

The process to reduce acidity in hydrocarbon mixtures, the object of the present invention, will be better understood through the description given below, with example headings, together with the annexed drawings, which are an integral part of the present report.

According to a first embodiment of the process to treat hydrocarbon mixtures after the preflash tower (2) and before the atmospheric distillation tower (7) that it is shown in FIG. 1, the treatment of the hydrocarbon mixture flow (1) with TAN levels of between 1 and 10 mg KOH/g of oil takes place through the following stages:

a) the liquid effluent (3) of the preflash tower (2) at a typical temperature of 260° C. to 280° C. is directed towards a Microwave Treatment Unit (MTU), where it enters into contact with a fixed or mud bed made up of microwave absorbent material, under the action of the microwaves;

b) in the said Microwave Treatment Unit (MTU), the hydrocarbon stream processing temperature under microwaves is within a range of between 260° C. and 450° C., preferably between 280° C. and 350° C., and even better if this temperature is equal (or as close as possible) to the temperature of the hydrocarbon stream upon entering into the atmospheric distillation tower (7), thus reducing the need for thermal exchange;

c) in the event that the Microwave Treatment Unit (MTU) operates above or below the normal temperature of hydrocarbon stream within the atmospheric distillation tower (7), or effluent (4) of the Microwave Treatment Unit (MTU) or a fraction (4*a*) of this effluent flow (4) in the MTU, it is sent to the battery of heat exchangers (5), to carry out the thermal exchange;

d) the flow mixture that constitutes the treated flow (6) and is already at the temperature of a normal atmospheric distillation tower (7) hydrocarbon stream is sent towards the atmospheric distillation tower (7), which operates in the conventional way.

The option of processing the oil treatment after desalination (see FIG. 2), in addition to reducing acidity in the hydrocarbon stream, offers an additional benefit of increasing the probability of breaking down the emulsions difficult to treat in the desalination stage.

The option of processing the petroleum treatment before desalting (see FIG. 3), offers an additional benefit of increasing the probability of breaking down the emulsions while reducing naphthenic acidity in the hydrocarbon mixture.

Figure 2:
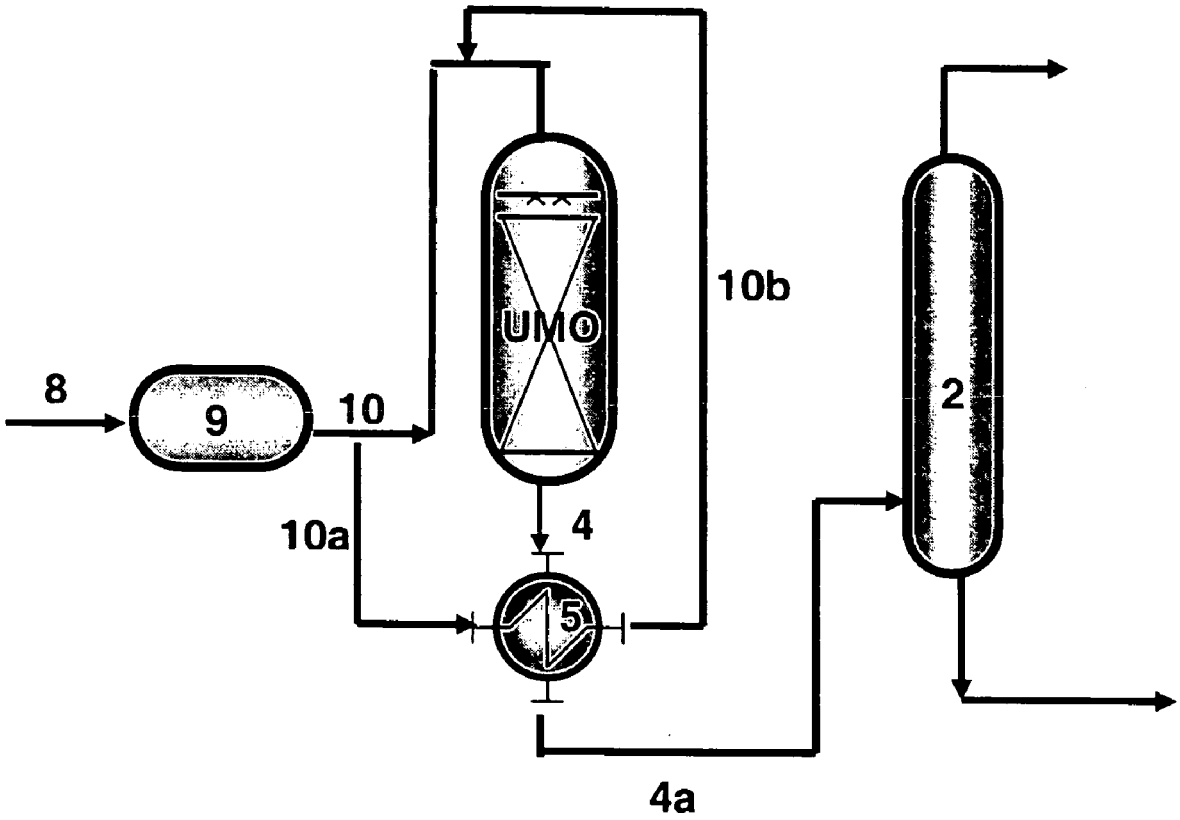
FIG. 2 is a schematic flowchart with a second embodiment of the process of the invention applied to the treatment of hydrocarbon mixtures after the desalination unit and before the preflash tower.

FIG. 2 describes a second embodiment of the process where processing the hydrocarbon mixture with a high acid value occurs after the desalination stage in the desalinator (9) and before the daily preflash tower (2).

The high acid value hydrocarbon mixture (8) treatment includes the following stages:

a) Direct the high acid value hydrocarbon mixture (8) towards the desalinator (9) where it is desalinated, producing a desalinated oil flow (10), kept at the processing temperature. Said desalinated oil flow (10) is sent to a Microwave Treatment Unit (MTU), where it enters into contact with the microwave absorbent material, under the action of microwaves;

b) The hydrocarbon stream processing temperature may be within a range of between 120° C. and 450° C., preferably between 240° C. and 350° C., and even better if this temperature is equal (or as close as possible) to the temperature of the preflash tower hydrocarbon stream (2), thus reducing the spent energy in thermal exchange;

c) the effluent (4) from the MTU, which is at the temperature of the preflash tower hydrocarbon stream (2) shall be transported to the aforementioned preflash tower (2), following the standard refining process;

d) in the event that the MTU operates above the temperature of the preflash tower (2), a fraction (10*a*) of the desalted oil flow (10) coming from the desalinator (9), is sent to a heat exchanger (5) where it is put into contact with the effluent (4) from the MTU to reduce its temperature to the temperature of the hydrocarbon stream (4*a*) from the preflash tower (2), generating a fractional flow (10*b*) that upon being mixed into the desalted oil flow (10) raises the temperature of said desalted oil flow (10).

This implementation reduces energy consumption used in the microwave system.

Figure 3:
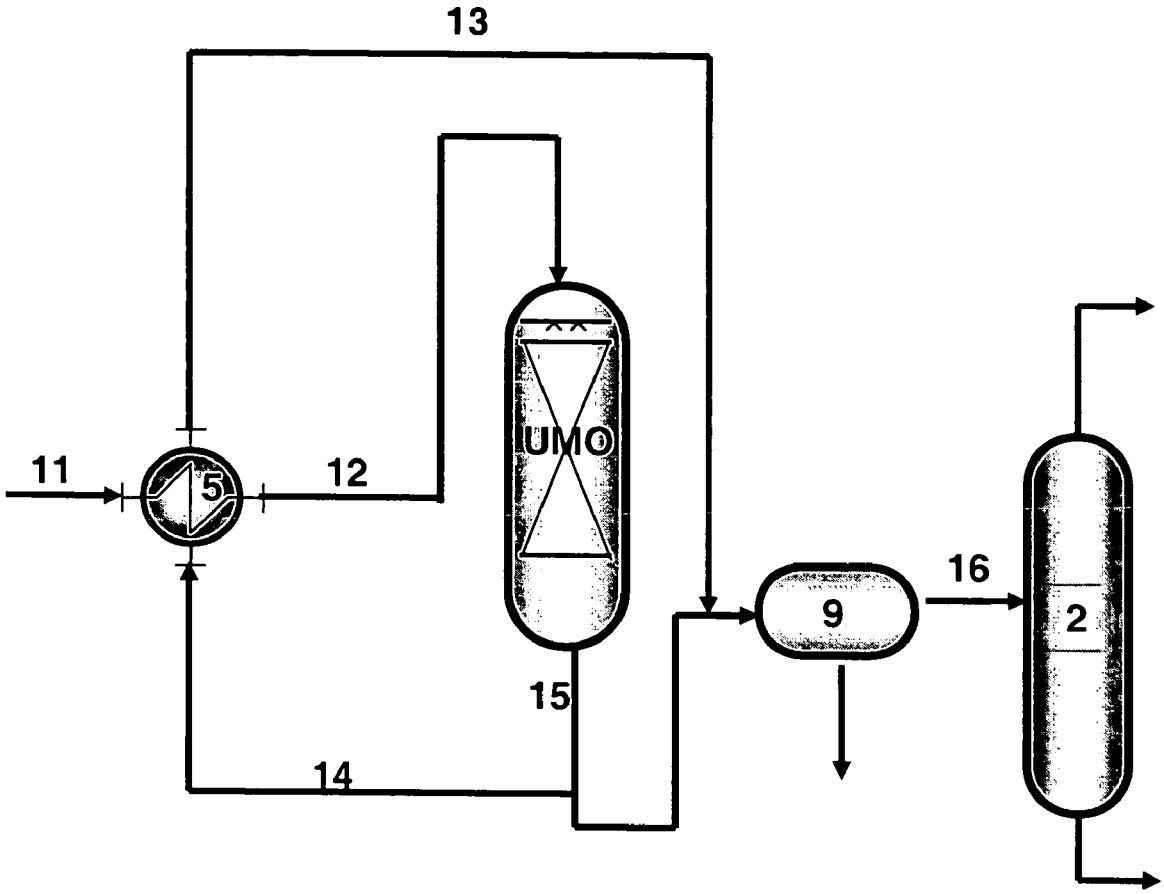
FIG. 3 is a schematic flowchart with a third embodiment of the process of the invention applied to the treatment of hydrocarbon mixtures before the desalination unit.

FIG. 3 describes a third implementation of the process where a diagramed flowchart presents the treatment of the hydrocarbon mixture with a high acid value in an MTU before the desalination stage in the desalinator (9)

The brackish petroleum stream (11) treatment includes the following stages:

a) the brackish petroleum stream (11) passes through a first battery of heat exchangers (5), the effluent of which (12), preheated and kept at a typical desalination processing temperature is sent to a Microwave Treatment Unit (MTU), where it enters into contact with microwave absorbent material, under the action of the microwaves;

b) The hydrocarbon stream processing temperature may be within a range of between 120° C. and 450° C., preferably between 140° C. and 300° C., and even better if this temperature is as close as possible to the temperature of the desalinator, thus reducing the power spent in thermal exchange;

c) in the event that the microwave unit operates at a temperature above the temperature of the desalinator (9), an effluent stream (15) of the MTU is, in part, sent directly to the desalinator (9), while another fraction (14) is sent through a battery of heat exchangers (5), where, in order to reduce its temperature, it is put into contact with the crude oil. The battery of heat exchangers (5) produces a cooled stream (13) to be mixed into a portion of the effluent stream (15) of the Microwave Treatment Unit (MTU) and to be sent to the desalinator (9). The effluent oil stream from the desalinator (16) is sent to the preflash tower (2), where it is processed in the usual manner.

Figure 4:
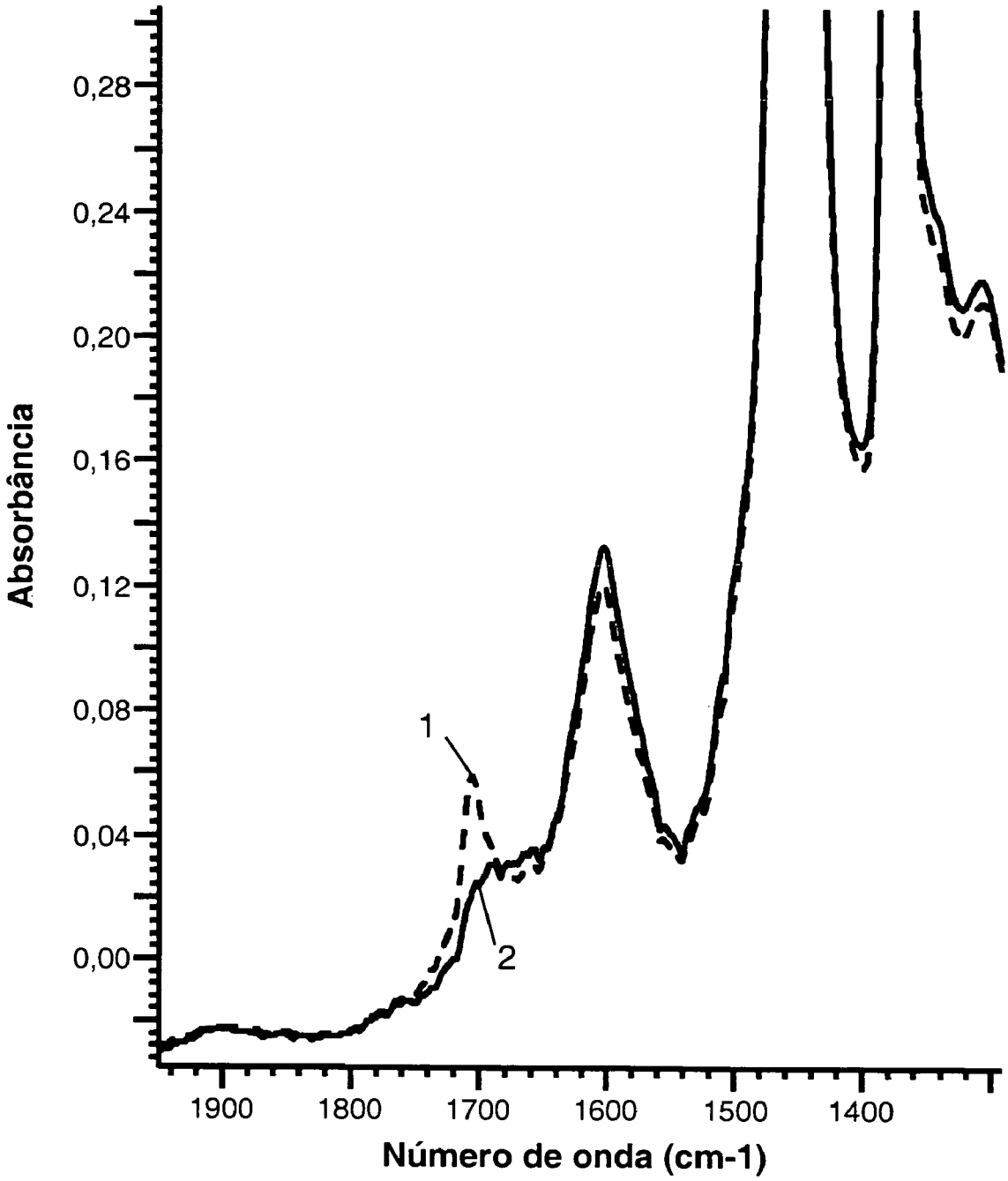
FIG. 4 is an illustration with curves 1 and 2 showing the detail of the infra-red spectrum in the region of carbonyl and carboxyl absorption from the naphthenic acids in a stream of hydrocarbons, respectively before and after the treatment according to the process of the invention.

Curves 1 and 2 of FIG. 4 present, respectively, the detail of the infrared spectrum of a hydrocarbon stream, before treatment (TAN=2.68 mg KOH/g hydrocarbon) and after the treatment as proposed by the process of the invention (as provided by TAN=0.78 mg KOH/g of hydrocarbon and as determined by TAN=0.8 AIT mg KOH g hydrocarbon).

Note that in the detail of Curve 2 of FIG. 4 may be found at 1715 $cm^{-1}$ through strong reduction of the peak corresponding to the absorption of carboxyl carbonyl from the naphthenic acids, after the treatment by microwaves proposed in this process.

The invention will be illustrated below by the following nonrestrictive Examples.

EXAMPLE 1

In a reactor consisting of a glass balloon with 3 openings, coated with a thermal insulator that is transparent to microwaves, called caol (aluminum silicate), provided with thermocouple and condenser for reflux sites and installed inside of glass tank, 200 g of petroleum that was not desalinated was fed in, presenting a TAN of 3.2 mg KOH/g oil and 60 g of sulfided catalyst, spent, with a Ni/Mo based, supported in alumina, removed from an industrial HDT unit. The hydrocarbon stream was processed under the following operating conditions: Atmospheric pressure; nominal rated power of the microwave oven of only 200 W, pulse mode; initial temperature of hydrocarbon stream equal to the environment. After 70 minutes the hydrocarbon stream reached the temperature of 295° C. and remained at this temperature for only 10 minutes. The TAN determined in the irradiated hydrocarbon stream was up to 0.8 mg KOH/ g oil. However, the same hydrocarbon stream, in the presence of the same catalyst, and with the same ratio of catalyst/oil, when warmed in the conventional manner, required 80 minutes at the temperature of 320° C. to reduce the TAN up to 1.3 mg KOH/g of oil, and 20 minutes to reduce the TAN up to 2.3 mg KOH/g of oil.

EXAMPLE 2

In order to verify the effect of the composition of the microwave absorber, in a reactor consisting of a glass balloon with 3 openings, coated with a thermal insulator that is transparent to microwaves, called caol (aluminum silicate), provided with thermocouple and condenser for reflux sites and mechanical stirring, installed inside of glass tank, 200 g of petroleum that was not desalinated was fed in, presenting a TAN of 3.2 mg KOH/g oil and 60 g of a sulfided, spent Ni/Mo catalyst, withdrawn from a catalytic hydrocracking pilot unit, The hydrocarbon stream was processed under the following operating conditions: Atmospheric pressure; nominal rated power of the microwave oven of only 200 W, pulse mode; initial temperature of hydrocarbon stream equal to 145° C. After 120 minutes the hydrocarbon stream attained the temperature of 290° C. At that point, the reaction was discontinued immediately.

The TAN values determined in the treated hydrocarbon streams as a function of the type of adsorbent, are shown in Table 1, where one may see the effect of sulfidation of the spent catalyst through more significant reduction in the TAN value.

TABLE 1

| Test | Adsorbent Catalyst | TAN (mg KOH/g oil) |
|---|---|---|
| 1 | Spent Sulfided | 1.77 |
| 2 | Spent Oxidated A | 2.32 |
| 3 | Spent Oxidated B | 2.34 |

Other implementations of the invention are also utilized for treatment of hydrocarbon fraction streams in processes such as atmospheric and vacuum distillation, fluid catalytic cracking, delayed coking, or mixtures of these, whether they are to continue on to treatments afterwards or not, such as hydrotreatment.

The description made here of the process for reducing acidity in hydrocarbon mixture, the object of the present invention, should be considered only as a possibility or possible embodiments, and any particular characteristics introduced herein should be understood only as something that was described to facilitate understanding. In this way, they should not in any way be considered as limitations of the invention, which is limited to the scope of the claims that follow.

The invention claimed is:

1. Process for reducing the acidity of a hydrocarbon mixture with a high acid value, comprising:

a) heating said hydrocarbon mixture at temperatures of between 120° C. and 450° C, b) directing the heated mixture to a Microwave Treatment Unit (MTU) equipped with a microwave oven, inside which said mixture enters into continuous contact with a fixed stream or mud bed, made up of a microwave absorbent material, under the action of microwave energy in the range of between 1 mm to 30 cm or 1 to 30 GHz, at a temperature of between 260° C. and 450° C., in order to effect an organic acid reaction in said hydrocarbon mixture with a surface made from said microwave absorbent material, under irradiation of microwaves inside said oven;

c) continuously removing from said oven, the effluent from the Microwave Treatment Unit (MTU), having a reduced TAN value, for later processing in refining units of a refining system, so that:

i) after the irradiation treatment, the treated hydrocarbon mixture will be at a normal pressure of the refining system; and ii) the spatial velocity of the treated hydrocarbon mixture falls in a range of between 0.25 and 10 $h^{-1}$; and d) disposing of the microwave absorbent material at the end of the campaign time.

2. Process according to claim 1, wherein said process is applied to a crude oil refining process which comprises the following steps:

a) heating the crude oil in a heat exchanger, thus obtaining a heated crude oil;

b) desalting the heated crude oil in a desalinator, thus obtaining a desalted crude oil;

c) separating light fractions from the desalted crude oil in a preflash tower, thus obtaining a treated oil; and d) distilling the treated oil from the preceding step in an atmospheric distillation tower and in a vacuum distillation tower.

3. Process according to claim 1, wherein the effluent from the Microwave Treatment Unit (MTU), or a fraction of the same, is selectively sent to a battery of heat exchangers to carry out thermal exchange.

4. Process according to claim 2, including heating hydrocarbon mixtures to be treated to temperatures that vary within a range of between 1 20° C. and 450° C. after a desalting step in a desalinator and before the preflash tower.

5. Process according to claim 2, characterized by being fully implemented after the preflash tower for removal of the light products.

6. Process according to claim 2, wherein the hydrocarbon mixture to be treated in the Microwave Treatment Unit (MTU) is a stream of desalted oil proceeding from a desalinator.

7. Process according to claim 2, including heating the hydrocarbon mixture with a high acid value to temperatures that vary within a range of between 120° C. and 450° C., before the desalinator.

8. Process according to claim 7, wherein a fraction of the desalinated stream, exchanges heat in a heat exchanger and leaves the heat exchanger as a fraction stream added to said desalinated stream.

9. Process according to claim 2, characterized by being totally implemented after the desalinator and before the preflash tower.

10. Process according to claim 1, characterized by including a hydrocarbon mixture to be treated while still a brackish petroleum stream, that after exchanging heat in a heat exchanger, produces a stream sent to the Microwave Treatment Unit (MTU), from where it leaves as an effluent stream that is, in part, sent directly to a desalinator, while the other fraction is sent to a battery of heat exchangers (5) from which it leaves as a cooled stream to be mixed into a portion of the effluent stream of the Microwave Treatment Unit (MTU) and sent to the desalinator.

11. Process according to claim 10, wherein it is completely implemented before going through the desalinator.

12. Process according to claim 1, wherein the hydrocarbon mixtures are selected from: petroleum products, their fractions and derivatives.

13. Process according to claim 1, characterized by including hydrocarbon mixtures that present a total acidity number (TAN) that falls within a range of between 1 and 10 mg KOH/g of oil, preferably between 1.5 and 8 mg KOH/g of oil.

14. Process according to claim 1, wherein it also includes hydrogen in order to enhance its effects.

15. Process according to claim 1, wherein the microwave absorbent materials include coke fines, catalyst refuse from FCC or hydrotreatment units made up of transition supported by refractory oxides selected from among alumina, silica, titanium, zirconium; and refractory oxides, be they pure or mixed together in any proportion.

16. Process according to claim 15, wherein the microwave absorbent material is a spent catalyst used in a hydrotreatment process (HDT).

17. Process according to claim 15, wherein the microwave absorbent material is a spent catalyst used in a hydrotreatment process (HDT), sulfided or not.

18. Process according to claim 1, wherein the mass relation of the material that absorbs microwaves/hydrocarbon mixtures is between 0.05 and 1.

19. Process according to claim 16, characterized by possessing an intermediate step to rectify the spent catalyst in the presence of an inert gas.

20. Process according to claim 2, wherein it includes heating to temperatures that vary within a range of between 260° C. and 450° C., of hydrocarbon mixtures to be treated after the preflash tower.

21. Process according to claim 1, wherein it includes heating hydrocarbon mixtures to be treated to temperatures that vary within a range of between 160° C. and 450° C. before a finishing unit, fluid catalytic cracking, or hydrotreatment (HDT).

22. Process according to claim 1, wherein it is fully implemented for the treatment of specific flows such as, diesel oil, light recycled oil, (LCO), aviation kerosene, vacuum gas oils, and coke gas oils.

23. Process according to claim 1, characterized as including a process of additional heating in thermal exchange systems, of non-treated hydrocarbon mixtures with a treated hydrocarbon mixture, so as to reduce the temperature of the treated hydrocarbon mixture before they enter a desalinator.

24. Process according to claim 1, wherein within the microwave oven, the necessary temperature reaction to the treatment is such that it is as close as possible to the temperature of the downstream process.

25. Process according to claim 1, wherein said microwave oven (MTU), is either a conventional oven or not, is commercial or not, one mode or multi-mode, pulse or continuous, with fixed or variable microwave power and frequency.

* * * * *